United States Patent [19]

Piggin et al.

[11] Patent Number: 5,061,616

[45] Date of Patent: Oct. 29, 1991

[54] PROCESS OF PREPARING A TABULAR GRAIN SILVER BROMOIODIDE EMULSION

[75] Inventors: Roger H. Piggin, Abbots Langley, England; Philip J. Zola, Webster; Ming J. Lin, Penfield, both of N.Y.

[73] Assignee: Eastman Kodak Company, Rochester, N.Y.

[21] Appl. No.: 417,106

[22] Filed: Oct. 4, 1989

[30] Foreign Application Priority Data

Jul. 13, 1989 [GB] United Kingdom ..... 8916042

[51] Int. Cl.[5] ..... G03C 1/02

[52] U.S. Cl. ..... 430/569; 430/567

[58] Field of Search ..... 430/567, 569

[56] References Cited

U.S. PATENT DOCUMENTS

| | | | |
|---|---|---|---|
| 4,414,304 | 11/1983 | Dickerson | 430/353 |
| 4,414,310 | 11/1983 | Daubendiek | 430/567 |
| 4,425,425 | 1/1984 | Abbott et al. | 430/502 |
| 4,425,426 | 1/1984 | Abbott et al. | 430/502 |
| 4,433,048 | 2/1984 | Solberg et al. | 430/434 |
| 4,434,226 | 2/1984 | Wilgus et al. | 430/567 |
| 4,439,520 | 3/1984 | Kofron | 430/434 |
| 4,478,929 | 10/1984 | Jones et al. | 430/217 |
| 4,672,027 | 5/1987 | Daubendiek et al. | 430/505 |
| 4,693,964 | 9/1987 | Daubendiek et al. | 430/505 |
| 4,713,320 | 12/1987 | Maskasky | 430/567 |
| 4,806,461 | 2/1989 | Ikeda et al. | 430/567 |

FOREIGN PATENT DOCUMENTS 63-106746 5/1988 Japan .

OTHER PUBLICATIONS

Research Disclosure, vol. 229, Mar. 10, 1989, Item 29945.

*Primary Examiner*—Charles L. Bowers, Jr.
*Assistant Examiner*—Thorl Chea
*Attorney, Agent, or Firm*—Carl O. Thomas

[57] ABSTRACT

A process is disclosed for the preparation of a tabular grain silver bromoiodide emulsion in which silver bromoiodide laminae are formed on the major faces of the tabular grains. The sensitivity of the emulsion as a function of pressure applied is rendered more nearly constant by forming the silver bromoiodide laminae on the major faces of the tabular grains within a pAg and temperature range defined by Curve A in FIG. 1. The laminae are formed by first precipitating iodide as a silver salt at peripheral sites on the tabular grains and then precipitating silver bromoiodide onto the major faces of the host tabular grains with the primary source of iodide being the previously deposited iodide. The emulsions produced exhibit high sensitivity to exposing radiation and reduced sensitivity to localized pressure.

18 Claims, 2 Drawing Sheets

PROCESS OF PREPARING A TABULAR GRAIN SILVER BROMOIODIDE EMULSION

FIELD OF THE INVENTION

The invention relates to a process of preparing camera speed photographic emulsions and to the emulsions so produced. More specifically, the invention relates to a process for the preparation of tabular grain silver bromoiodide emulsions and to the emulsions produced thereby.

BACKGROUND OF THE INVENTION

The highest speed photographic emulsions are recognized to be silver bromoiodide emulsions. Because of their larger size, the presence of iodide ions in the silver bromide crystal structure of the grains is recognized to produce lattice irregularities that enhance latent image formation (observed as increased imaging sensitivity) on exposure to electromagnetic radiation.

Silver halide photography has benefited in this decade from the development of tabular grain silver bromoiodide emulsions. As employed herein the term "tabular grain emulsion" designates any emulsion in which at least 50 percent of the total grain projected area is accounted for by tabular grains. Whereas tabular grains have long been recognized to exist to some degree in conventional emulsions, only recently has the photographically advantageous role of the tabular grain shape been appreciated.

Tabular grain silver bromoiodide emulsions exhibiting particularly advantageous photographic properties include (i) high aspect ratio tabular grain silver halide emulsions and (ii) thin, intermediate aspect ratio tabular grain silver halide emulsions. High aspect ratio tabular grain emulsions are those in which the tabular grains exhibit an average aspect ratio of greater than 8:1. Thin, intermediate aspect ratio tabular grain emulsions are those in which the tabular grain emulsions of a thickness of less than 0.2 μm have an average aspect ratio in the range of from 5:1 to 8:1.

The common feature of high aspect ratio and thin, intermediate aspect ratio tabular grain emulsions, hereinafter collectively referred to as "recent tabular grain emulsions", is that tabular grain thickness is reduced in relation to the equivalent circular diameter of the tabular grains. Most of the recent tabular grain emulsions can be differentiated from those known in the art for many years by the following relationship:

$$ECD/t^2 > 25 \quad (1)$$

where

ECD is the average equivalent circular diameter in μm of the tabular grains and t is the average thickness in μm of the tabular grains.

The term "equivalent circular diameter" is employed in its art recognized sense to indicate the diameter of a circle having an area equal to that of the projected area of a grain, in this instance a tabular grain. All tabular grain averages referred to are to be understood to be number averages, except as otherwise indicated.

Since the average aspect ratio of a tabular grain emulsion satisfies relationship (2):

$$AR = ECD/t \quad (2)$$

where

AR is the average tabular grain aspect ratio and

ECD and t are as previously defined, it is apparent that relationship (1) can be alternatively written as relationship (3):

$$AR/t > 25 \quad (3)$$

Relationship (3) makes plain the importance of both average aspect ratios and average thicknesses of tabular grains in arriving at preferred tabular grain emulsions having the most desirable photographic properties.

The following illustrate recent tabular grain silver bromoiodide emulsions satisfying relationships (1) and (3):

R-1: U.S. Pat. No. 4,414,304, Dickerson;
R-2: U.S. Pat. No. 4,414,310, Daubendiek et al;
R-3: U.S. Pat. No. 4,425,425, Abbott et al;
R-4: U.S. Pat. No. 4,425,426, Abbott et al;
R-5: U.S. Pat. No. 4,434,226, Wilgus et al;
R-6: U.S. Pat. No. 4,439,520, Kofron et al;
R-7: U.S. Pat. No. 4,478,929, Jones et al;
R-8: U.S. Pat. No. 4,672,027, Daubendiek et al;
R-9: U.S. Pat. No. 4,693,964, Daubendiek et al;
R-10: U.S. Pat. No. 4,713,320, Maskasky; and
R-11: *Research Disclosure*, Vol. 299, Mar. 10, 1989, Item 29945.

*Research Disclosure* is published by Kenneth Mason Publications, Ltd., Dudley Annex, 21*a* North Street, Emsworth, Hampshire P010 7DQ, England.

The recent tabular grain emulsions have been observed to provide a large variety of photographic advantages, including, but not limited to, improved speed-granularity relationships, increased image sharpness, a capability for more rapid processing, increased covering power, reduced covering power loss at higher levels of forehardening, higher gamma for a given level of grain size dispersity, less image variance as a function of processing time and/or temperature variances, higher separations of blue and minus blue speeds, the capability of optimizing light transmission or reflectance as a function of grain thickness, and reduced susceptibility to background radiation damage in very high speed emulsions.

It has been recognized that still further improvements in emulsion sensitivity without any increase in granularity can be realized by forming recent tabular grain silver bromoiodide emulsions with iodide non-uniformly distributed within the grains. This is illustrated by the following patent:

R-12: U.S. Pat. No. 4,433,048, Solberg Piggin et al.

Solberg Piggin et al, which contains teachings compatible with and in most instances forming a integral part of the teachings of R-1 to R-11 inclusive, discloses forming tabular grain emulsions with a lower proportion of iodide in a central region of the tabular grain structure than in a laterally offset region. When iodide concentrations are progressively increased as the grains are grown, the central region preferably forms a minor part of the tabular grain. On the other hand, with abrupt differences in iodide concentrations between the central and laterally displaced regions, the central region preferably forms the major portion of the tabular grain.

R-13: U.S. Pat. No. 4,806,461, Ikeda et al to the extent pertinent is considered essentially cumulative with Solberg Piggin et al.

Investigations of tabular grain silver bromoiodide emulsions prepared according to the teachings of Solberg Piggin et al prepared by abruptly increasing iodide to form laterally displaced regions of the tabular grains has revealed that at least a portion of the iodide redistributes itself over the major faces of the tabular grains. Thus, higher iodide silver bromoiodide surface laminae have been identified on the tabular grains of these emulsions.

While the recent tabular grain emulsions have advanced the state of &he art in almost every grain related parameter of significance in silver halide photography, one area of concern has been the susceptibility of tabular grain emulsions to vary in their photographic response as a function of the application of localized pressure on the grains. As might be intuitively predicted from the high proportion of less compact grain geometries in the recent tabular grain emulsions, pressure (e.g., kinking, bending, or localized stress) desensitization, a long standing concern in silver halide photography, is a continuing concern in photographic elements containing recent tabular grain silver bromoiodide emulsions.

It is suggested by

R-14: Japanese Kokai SHO 63[1988]-106746, Shibata et al that the pressure sensitivity of emulsions with average aspect ratios of greater than 2:1 can be reduced by forming silver halide laminae of differing halide content on the major faces of the grains. A tabular grain silver bromoiodide emulsion with higher iodide levels in the tabular grain laminae prepared under the closest temperature and pAg conditions to those of the present invention is EM-5. As demonstrated by the Examples below, EM-5, shown in FIG. 1 as point R-14, is clearly outside the range of preparation conditions yielding emulsions of improved constancy of sensitivity as a function of pressure applied. In most instances Shibata et al formed tabular grain laminae at much higher excesses of halide ion (higher pAg levels).

SUMMARY OF THE INVENTION

In one aspect this invention is directed to a process for the preparation of a silver bromoiodide emulsion comprising providing a host emulsion comprised of a dispersing medium and silver bromide grains optionally including iodide in which greater than 50 percent of the total grain projected area is accounted for by tabular grains satisfying the relationship $$ECD/t^2 > 25$$

where

ECD is the mean effective circular diameter in μm of the tabular grains and t is the mean thickness in μm of the tabular grains and forming silver bromoiodide laminae on the major faces of the tabular grains.

The process is characterized in that sensitivity as a function of pressure applied to the silver bromoiodide emulsion is rendered more nearly constant by forming the silver bromoiodide laminae on the major faces of the tabular grains by the steps of (a) depositing iodide as a silver salt at peripheral sites on the host tabular grains and (b) within the pAg and temperature boundaries defined by Curve A in FIG. 1, precipitating silver bromoiodide onto the major faces of the host tabular grains with the primary source of iodide being the iodide deposited in step (a).

In another aspect, the invention is directed to tabular grain silver bromoiodide emulsions prepared by the processes of this invention.

It has been discovered quite unexpectedly that the sensitivity of recent tabular grain silver bromoiodide emulsions as a function of pressure applied in manufacture and/or use is markedly improved (rendered more nearly constant) by forming silver bromoiodide laminae on the major faces of the tabular grains within a selected range of pAg and temperature conditions while including iodide previously deposited at the edges of the tabular grains. Further, the invention achieves this increased constancy of sensitivity as a function of applied pressure while still exhibiting the superior sensitivity levels demonstrated by recent silver bromoiodide tabular grain emulsions with non-uniform iodide distributions.

BRIEF DESCRIPTION OF THE DRAWINGS

The invention can be better appreciated by reference to the following detailed description considered in conjunction with the drawings, in which.

DESCRIPTION OF PREFERRED EMBODIMENTS

Figure 1:
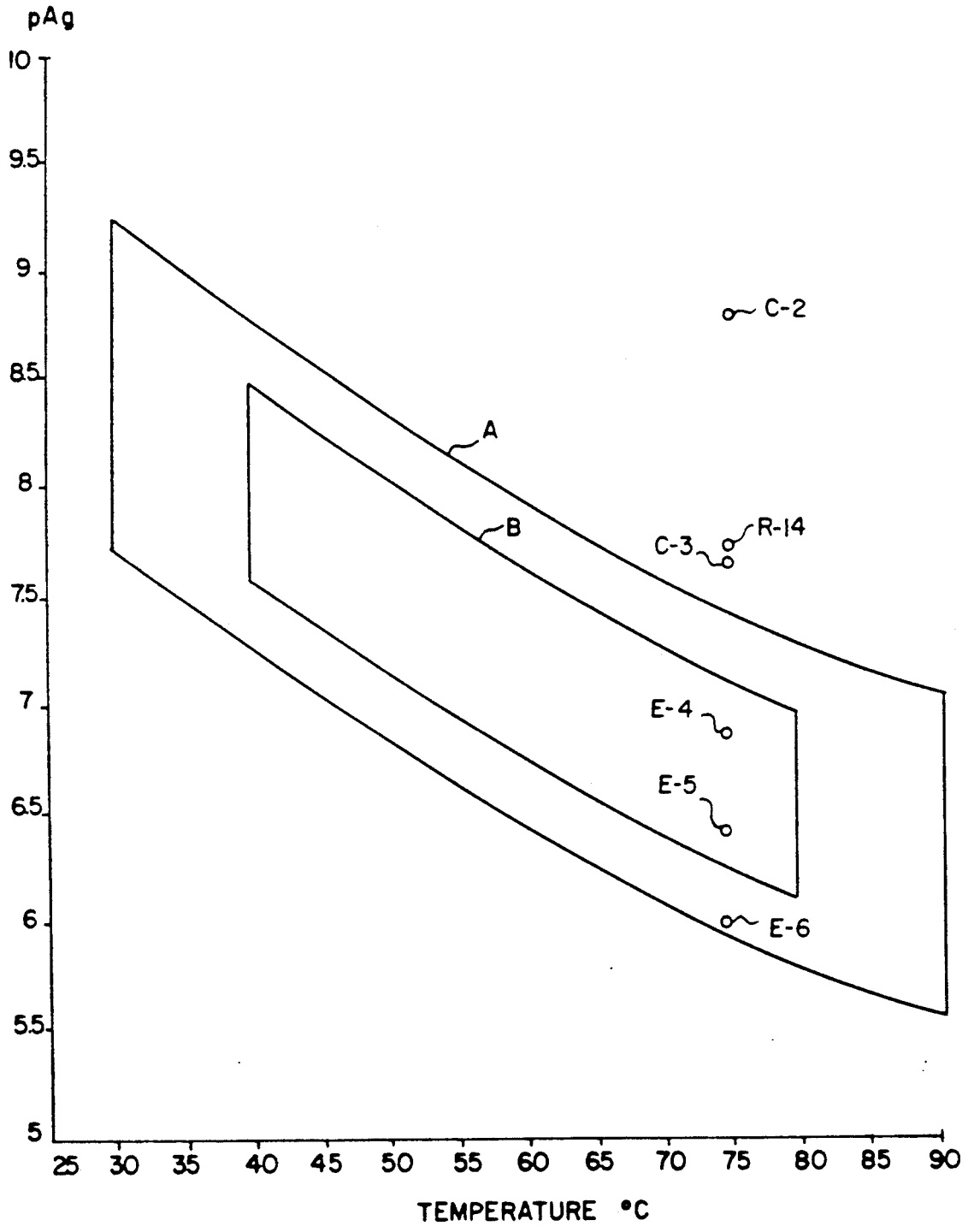
FIG. 1 is a plot of pAg versus temperature in degrees Celsius.

The present invention is based on the discovery that the sensitivity advantages of the recent tabular grain silver bromoiodide emulsion technology can be realized while at the same time achieving sensitivity levels that are more nearly constant as a function of applied pressure than have been characteristic of recent tabular grain silver bromoiodide emulsions heretofore available to those skilled in the art. Alternatively stated, the present invention is based on the discovery of recent tabular grain emulsions and methods for their manufacture which are less susceptible to pressure desensitization. Pressure desensitization can arise from bending, kinking, spooling, dragging across out of adjustment transport rolls, any type of compressive force, and any other manipulation that applies pressure to the emulsion layer or layers of a photographic element. While pressure desensitization can occur over all or part of the photographic element, localized pressure desensitization is most objectionable, since it is highly visible as a local defect in the photographic image.

The present invention is predicated on the discovery of a selected set of conditions for forming silver bromoiodide laminae on the major surfaces of tabular grains. Specifically, achieving both high levels of sensitivity and resistance to pressure desensitization results from first depositing iodide at the edges or corners of the tabular grains under conditions known to promote high levels of sensitivity and then recrystallizing the iodide under newly identified and selected conditions so that it is distributed within the laminae on the major faces of the grains. In a specifically preferred form of the invention the iodide forming the laminae is both initially deposited and recrystallized under the newly identified and selected conditions. Recrystallization is undertaken under conditions more nearly approaching the equivalence point than have heretofore been employed in forming tabular grain silver bromoiodide laminae. The equivalence point is a 1:1 atomic ratio of silver ion to halide ion in solution. With rare exceptions photographic silver halide emulsions are precipitated on the halide side of the equivalence point (with an excess of halide ions as compared to silver ions). This is undertaken to avoid occlusions within the grains of excess silver ion, thereby guarding against elevated minimum densities (i.e., fog).

By employing state-of-the-art analytical tools and referring to known physical relationships some tantalizing indications of the unique nature of the silver bromoiodide laminae formed have been obtained, but no theoretical rationale capable of accounting for the outstanding performance of the emulsions of this invention has emerged. For example, it has been recognized in investigating this invention that by precipitating the silver bromoiodide laminae nearer to the equivalence point the large solubility difference between silver bromide and silver iodide is narrowed. This suggests that bromide and iodide ions may form with silver a more orderly cubic crystal lattice than is otherwise possible and that the increased order of the crystal lattice is responsible for the more nearly constant sensitivity of the emulsions as a function of applied pressure. It has also been suggested that the peripheral deposition of iodide as a silver salt according to the teachings of R-12 (Solberg Piggin et al) results in an increase in crystal lattice defect sites capable of contributing to latent image formation and that this accounts for observed increased sensitivity. However, there remains no corroborated explanation of why the high levels of sensitivity attributable to peripheral iodide deposition persist after the peripheral iodide has been recrystallized as silver bromoiodide over the major faces of the tabular grains.

To complicate matters further, the tabular grains of the emulsions of this invention can exhibit a distinctive and novel edge contour. This novel edge contour provides a convenient identification signature of emulsions prepared according a preferred preparation process of this invention. No tabular grain silver bromoiodide emulsion having a similar grain edge configuration is known to have been prepared by a process other than that of the present invention; however, similarly advantageous results have been achieved in emulsions contemporaneously prepared lacking the novel tabular grain edge contour.

While emulsion theory and grain analyses are suggestive, a clear and conclusive cause and effect relationship has been established between emulsion preparation steps and improved photographic performance. Accordingly, the emulsions of the invention are described in terms of the steps employed in their preparation, supplemented by analytical observations.

The first step in the preparation of an emulsion demonstrating the advantages of this invention is the preparation or selection for use as a host emulsion of a recent tabular grain emulsion containing a dispersing medium and silver bromide grains optionally containing iodide satisfying relationships (1) and (3) above. Any convenient conventional emulsion of this type can be prepared or selected. Preferred emulsions are illustrated by the teachings of R-1 to R-11, cited above and here incorporated by reference. As taught by R-6 (Kofron et al), the preparation of tabular grain silver bromoiodide emulsions can be readily adapted to forming tabular grain silver bromide emulsions merely by omitting iodide from the precipitation process. The sole exception to this is the precipitation process of R-2 (Daubendiek et al), which requires the use of silver iodide seed grains for tabular grain nucleation and is therefore limited to the preparation of silver bromoiodide emulsions. Apart from allowing the alternative of omitting iodide entirely, the same iodide ranges taught by R-1 to R-11 are specifically contemplated.

Since silver bromoiodide laminae are to be deposited onto the major faces of the tabular grains of the host emulsion, the tabular grains of the silver bromoiodide product emulsions exhibit somewhat greater thickness than the host tabular grains from which they are prepared. Where the silver bromoiodide laminae are of minimum thickness, about 5 percent to total tabular grain thickness, the increased thickness of the silver bromoiodide product emulsion tabular grains is generally negligible.

Nevertheless, if it is intended that the product silver bromoiodide emulsion also satisfy relationships (1) and (3), as is preferred for the highest levels of performance, the ratio of tabular grain diameter to thickness of the host emulsion reflected in relationships (1) and (3) is increased somewhat above the minimum values indicated above. Preferably the tabular grain diameter to thickness ratio of relationships (1) and (3) is greater than 40 and optimally greater than 80. Preferred host tabular grain emulsions are those in which the mean tabular grain thickness is less than 0.2 μm. Since the benefits of the invention are provided by tabular grains, it is preferred that tabular grains account for at least 70 percent and optimally at least 90 percent of the total grain projected area of the host emulsion.

The tabular grain host emulsion is generally chosen to provide a mean tabular grain effective circular diameter at least 50 percent, preferably at least 90 percent, that of the silver bromoiodide product emulsion. It is possible to form the silver bromoiodide product emulsion without increasing the mean effective circular diameter of the product emulsion as compared to that of host emulsion. The host emulsion can account for as little as 10 percent, based on silver, of the silver bromoiodide product emulsion. Host emulsions in which the tabular grains are relatively thin (e.g., less than 0.2 μm and preferably less than 0.1 μm) particularly lend themselves to forming product emulsions in which silver bromoiodide laminae account for most of the silver. By forming the laminae on the host grains of minimum thickness the host emulsion can account for up to 94.9 percent of the total silver forming the silver bromoiodide product emulsion. The host emulsion preferably accounts for from 40 percent to 90 percent of the total silver forming the silver bromoiodide product emulsion.

Any conventional approach for depositing iodide as a silver salt at peripheral sites on tabular grains of the host emulsion can be employed in the practice of this invention. Since the disproportionate diameter of tabular grains in relation to their thickness is the result of selective growth at the edges of the tabular grains, it is apparent that iodide can be readily directed to peripheral sites on the tabular grains. The techniques taught by R-12 (Solberg Piggin et al), cited above and here incorporated by reference, for abruptly introducing iodide salts during tabular grain precipitation are compatible with the practice of this invention.

To drive peripheral deposition of iodide while minimizing metastasis of bromide ion in the host tabular grains, iodide is generally introduced abruptly—that is, over a relatively short period, less 10 minutes, preferably less than 1 minute, and optimally less than 10 seconds. Abruptly introduced iodide is sometimes referred to as "dump iodide", since the preferred practice is to introduce the iodide as quickly as the halide salt delivery apparatus permits. A simple way of accomplishing this is to turn the iodide delivery Jet to its full open position while stirring the host emulsion.

For a silver salt of iodide to be deposited, silver counter ions must be provided. Silver can be introduced concurrently with iodide introduction or immediately following iodide introduction. The concurrent introduction of silver and iodide in the form of a conventional silver iodide Lippmann emulsion results in the peripheral deposition of silver bromoiodide typically containing about 30 mole percent iodide. Lippmann grains, typically less than 0.1 μm in diameter, nearly instantaneous recrystallize into the host emulsion. The bromide ion is provided by the stoichiometric excess of bromide ion present in the host emulsion at the preferred pAg conditions for iodide introduction.

Concurrent introduction of soluble silver and iodide salts are alternatively possible. While any soluble silver salt known to be useful in silver halide precipitations can be employed, silver nitrate is almost universally employed in the art. Similarly, while any soluble iodide salt known to be useful in precipitating silver iodide emulsions can be employed, alkali metal iodide salts, particularly potassium iodide, are preferred. When a soluble iodide salt is employed, it is generally a practical convenience to first introduce the dump iodide followed by immediate adjustment of silver ion concentrations by correlating silver ion addition with the silver electrode potential, which in turn correlates with the emulsion pAg. When iodide is added as a soluble salt, the peripheral iodide appears to be deposited as a silver iodide or a high iodide silver bromoiodide. As employed herein the term "high iodide silver bromoiodide" indicates a silver iodide crystal lattice in which iodide accounts for at least 90 percent of the total halide, based on silver. This is an entirely different crystalline structure than exhibited by ordinary photographic silver bromoiodides.

Only a very small amount of iodide need be peripherally deposited on the host tabular grains as a silver salt to achieve the advantages of the invention. On the other hand, much more iodide can be peripherally deposited without adverse effect. Iodide depositions ranging from 0.1 to 30 percent, preferably 0.5 to 4 percent, based on total silver of the product emulsion are contemplated.

R-12 (Solberg Piggin et al) observed both continuous and discontinuous peripheral iodide epitaxy. Either (a) corner or (b) edge and corner epitaxial deposition of silver iodide onto the host tabular grains is possible. It is preferred to achieve peripheral iodide deposition at or near the corners of the host tabular grains, as described below.

Once a tabular grain host emulsion has been obtained with a silver salt of iodide located at peripheral sites on the tabular grains, the next step of the process is to redistribute the iodide over the major faces of the host tabular grains as part of silver bromoiodide laminae. As demonstrated by the Comparative Examples, presented below, realization of the advantages of the invention requires the laminae to be formed within a selected pAg range.

Referring to FIG. 1, to be effective in achieving the advantages of the invention the pAg employed for silver bromoiodide laminae formation is that indicated by the higher and lower pAg boundaries indicated by Curve A, with the higher and lower pAg boundaries of Curve B defining preferred pAg ranges. Unlike the upper and lower pAg boundaries the temperature limits of 30° to 90° C. for Curve A and 40° to 80° C. for Curve B are not critical, but are selected to reflect the temperature ranges most commonly and conveniently employed in preparing photographic emulsions.

The variance of effective pAg limits as a function of temperature is directly related to the known variance of the solubility product constant of silver bromide ($K_{sp}$) with temperature. In a simple emulsion in which silver and halide ions are in equilibrium, the relationship between $K_{sp}$ and pAg can be expressed as follows:

$$-\log K_{sp} = pAg + pX \quad (4)$$

where $K_{sp}$ is the solubility product constant for the emulsion;

pAg is the negative logrithm of silver ion activity; and pX is the negative logrithm of halide ion activity. For silver bromide $-\log K_{sp}$ varies from 10.1 at 80° C. to 11.6 at 40° C., a difference of one and half orders of magnitude. For silver iodide $-\log K_{sp}$ varies from 13.2 at 80° C. to 15.2 at 40° C. Since the $-\log K_{sp}$ of silver bromide is about 3 orders of magnitude (1000 times) greater than that of silver iodide, it is apparent that it is the $-\log K_{sp}$ of silver bromide that controls pAg in a silver bromoiodide emulsion under equilibrium conditions. Other silver salt forming anions, if present, can have a greater or lesser influence, depending upon their relative solubilities.

As has been previously stated, one of the features of the present invention is that the silver bromoiodide laminae are formed on the halide side of, but nearer, the equivalence point than prior art emulsions. The equivalence point of an emulsion of a silver halide emulsion satisfies the relationship:

$$pAg = pX = -\log K_{sp}/2 \quad (5)$$

Thus, the lower boundaries of Curves A and B must be varied as a function of temperature to insure that they remain in a fixed relationship with the equivalence point of the emulsion at each temperature within the range. Once the upper and lower limits of the pAg boundaries have been established at a selected temperature, it is apparent that temperature adjustments of pAg limits can be achieved from known temperature versus $-\log K_{sp}$ relationships. Referring to FIG. 1, it is apparent that the upper and lower boundaries of Curve A were established at 75° C. to be pAg values of 7.5 and 6.0, respectively. Similarly, the upper and lower boundaries of Curve B were established at 75° C. to be pAg values of 7.0 and 6.25, respectively. The remainder of the upper and lower boundaries of Curves A and B can be determined from a knowledge of equivalence points at other temperatures in the 30° to 90° C. range.

While maintaining the host emulsion with the silver iodide epitaxially deposited on the host tabular grains within the the pAg boundaries identified above, silver bromide is precipitated onto the major faces of the tabular grains employing any convenient conventional silver bromide precipitation technique. For example, silver and bromide soluble salts, typically silver nitrate and an ammonium or alkali metal bromide. are concurrently introduced through separate silver and bromide Jets. During deposition of silver bromide on the major faces of the host tabular grains the peripheral iodide enters solution and is redeposited with the silver bromide to form the silver bromoiodide laminae.

Deposition of the silver bromoiodide laminae is preferably continued until the peripheral iodide has been entirely redistributed over the major faces of the host tabular grains. At a minimum at least 5 percent, preferably at least 10 percent, of the silver introduced in forming the silver bromoiodide product emulsion is introduced during the formation of the silver bromoiodide laminae. From silver ranges of the host emulsion and the peripheral iodide silver salt, it is apparent that the silver bromoiodide can account for as much as 89.9 (preferably as much as 59.5 percent) of the total silver forming the silver bromoiodide product emulsion.

While it is preferred to introduce bromide as the sole halide salt during formation of the silver bromoiodide laminae, it is possible to also introduce any additional amount of iodide compatible with redistributing the peripheral iodide. Iodide introduced into the emulsion during silver bromoiodide laminae formation is preferably limited to less than 5 percent, preferably less than 1 percent, of total halide introduced during laminae formation. The reason for limiting iodide introduction is to allow peripheral iodide redistribution at a maximum or near maximum rate. With lowered rates of silver bromide addition, a longer time period for iodide redistribution is provided and elevated levels of iodide introduction with the bromide salt are considered feasible.

Figure 2:
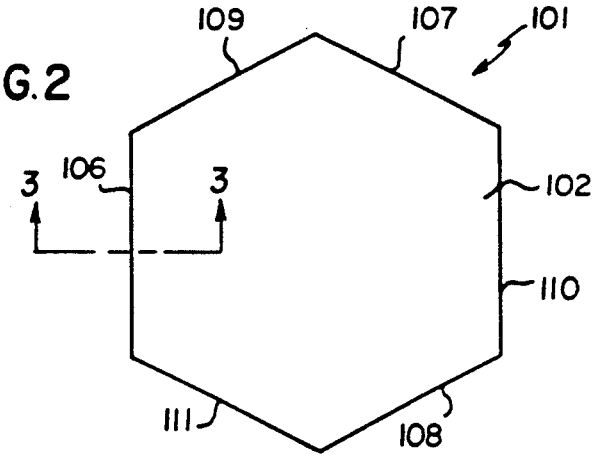
FIGS. 2 and 4 to 6 inclusive show a single tabular grain at successive stages of emulsion preparation.
Figure 3:
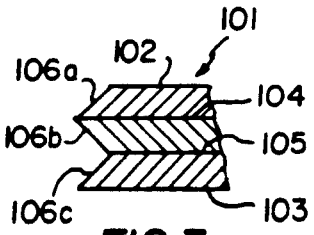
FIG. 3 is a sectional detail as viewed along section line 3—3 in FIG. 2.

A preferred mode of practicing the invention is illustrated by reference to FIGS. 2 to 7 inclusive. In FIG. 2 a tabular grain 101 of a host emulsion is shown. Referring to FIG. 3, it is apparent that the tabular grain has two parallel major crystal faces 102 and 103. Running through the grain parallel to the major crystal faces are parallel twin planes 104 and 105. Edge 106, shown in section in FIG. 3, consists of three separate crystal facets 106*a*, 106*b*, and 106*c*. Crystal facet 106*a* extends from the upper major crystal face to the upper twin plane 104, crystal facet 106*b* extends from the upper twin plane 104 to the lower twin plane 105, and crystal face 106*c* extends from the lower twin plane to the lower major crystal face 103. Edges 106, 107, and 108 are identical. Edges 109, 110, and 111 are like edges 106, 107, and 108, except that the crystal facets form an acute angle with the upper major crystal face and an obtuse angle of intersection with the lower major crystal face. Stated another way, if the reference numerals 102 and 103 were reversed, FIG. 3 would constitute an accurate representation of the edges 109, 110, and 111.

While host tabular grain 102 is for simplicity shown to have regular hexagonal major crystal faces and to contain two twin planes, it is appreciated that the major crystal faces of tabular grains commonly take alternative forms and the number of twin planes vary. For example, grains containing an uneven number of twin planes often have triangular major crystal faces or three edges of one length alternated with three edges of a different length. Other tabular grain shapes, including trapezoidal shapes are known. A discussion of the correlation of tabular grain shapes and their occluded twin planes is provided by Maskasky U.S. Pat. No. 4,684,607, the disclosure of which is here incorporated by reference.

Figure 4:
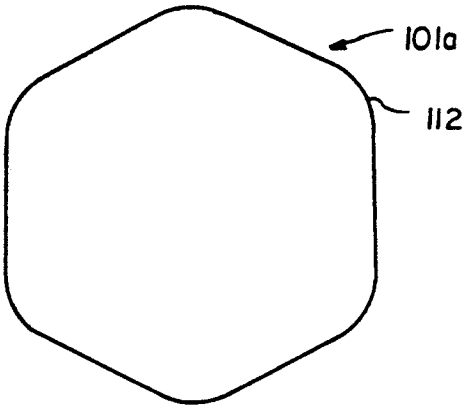

When the pAg of the host emulsion is reduced by silver ion addition to come within the boundary of Curve A or B in FIG. 1, ripening of the grain occurs leading to rounding of the corners (coynes in crystallographic terminology) of the grains. This is shown in FIG. 4, wherein the ripened grain 101*a* is shown to have rounded corners 112.

Figure 5:
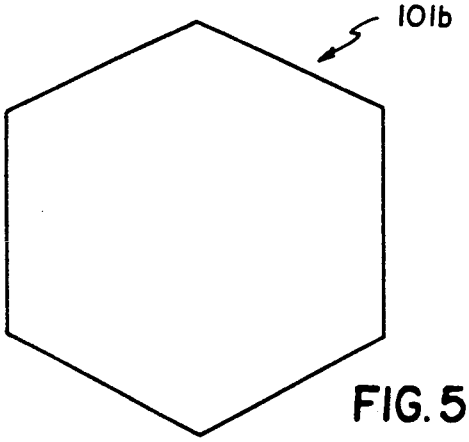

When a silver salt of iodide is precipitated onto the tabular grain brought within the boundary of Curve A or B in FIG. 1 by silver ion addition, the iodide selectively deposits at the rounded corners. If continued, the silver iodide can restore the original projected profile of the tabular grain. The grain 101*b* as shown in FIG. 5 appears similar to grain 101 from which it was derived. Grain 101*b* is, however, significantly different from the grain 101 in FIG. 2 from which it is produced, since the corners of the tabular grain 101*b* consists of the later precipitated silver salt of iodide. Depending on the amount of additional deposition, the tabular grain 101*b* can retain some rounding of the corners, like grain 101*a*; exactly fill in the corners of the grains, as shown in FIG. 5; or can contain more silver salt at the corners than can be accommodated within the original projected profile of the grains. In the latter instance the peripheral iodide can appear as castellations adjacent the corners of the grains. With relatively high proportions of later deposited silver salt the castellations can form a continuous peripheral decoration of the tabular grain structure.

If the pAg of the emulsion is reduced by means other than silver ion addition, the corners of the tabular grains do not become rounded as shown in FIG. 2 and the later precipitated silver salt of iodide has not been observed to seek out the corners of the tabular grains, but rather to deposit along the edges of the tabular grains. The silver ion concentration of the emulsion can be increased without silver ion addition by any convenient conventional technique, such as ultrafiltration, as taught by Mignot U.S. Pat. No. 4,334,012 and *Research Disclosure*, Vol. 102, October 1972, Item 10208, and Vol. 131, March 1975, Item 13122 or coagulation washing, as taught by Yutzy and Russell U.S. Pat. No. 2,614,929.

Figure 6:
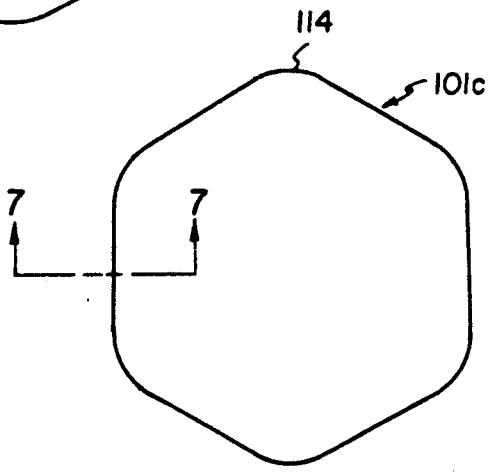

When silver and bromide salts are introduced to form the silver bromoiodide laminae, at least a portion of the silver iodide epitaxy is redistributed over the major faces of the tabular grains. FIG. 6 shows grain 101*c* after completion of laminae formation. The tabular grain exhibits rounded corners 114, indicative of redistribution of silver iodide epitaxy.

Figure 7:
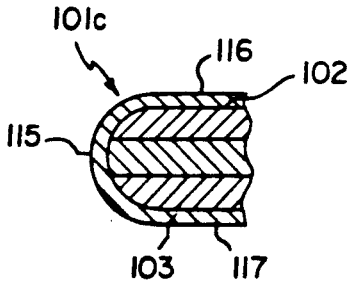
FIG. 7 is a sectional detail as viewed along section line 7—7 in FIG. 6.

Surprisingly, the edges of the grain 101*c* are also entirely changed in shape, as shown in FIG. 7. The edges of the tabular grain do not exhibit distinct crystal facets as shown in FIG. 3. Rather the tabular grain exhibits rounded edges 115. Silver bromoiodide lamina 116 is present on the upper major face 102 of the host tabular grain, thereby forming a new upper major face of the product tabular grain. Similar silver bromoiodide lamina 117 is present on the lower major face 103 of the host tabular grain, thereby forming a new lower major face of the product tabular grain. From cross sections of tabular grains it is believed that the upper and lower laminae are at least in some instances Joined along the rounded edges 115. Since ripening occurs at the edges of the tabular grains as they are formed, the mean effective diameter of the tabular grains of the silver bromoiodide product emulsion need not be larger than that of the host tabular grains.

It is recognized that the process of the invention can begin using tabular grains with silver iodide epitaxy at peripheral sites as starting materials. For example, the tabular grain emulsions of R-12 (Solberg Piggin et al) can be employed as a starting material, effectively taking the place of tabular grain 101*b* in the process sequence described above.

Other than the tabular silver bromoiodide grains themselves, the only other required feature of the emulsions is the dispersing medium in which the tabular grains are formed. Any conventional dispersing medium can be employed during preparation of the tabular grain silver bromoiodide emulsions of this invention. Since a peptizer must be present to hold the tabular host grains in suspension as the tabular host grains are grown, it is common practice to include at least a small amount of peptizer in the reaction vessel from the outset of precipitation. Low methionine gelatin (less than 30 micromoles methionine Per gram of gelatin) as taught by R-10 (Maskasky) constitutes a specifically preferred peptizer. The peptizer present during emulsion preparation described can range up to 30 percent by weight, preferably 0.5 to 20 percent by weight, of the total contents of the reaction vessel.

Once the emulsion has been formed, any conventional vehicle (typically a hydrophilic colloid) or vehicle extender (typically a latex) can be introduced to complete the emulsion binder employed in coating. The inclusion in the emulsion vehicle of methacrylate and acrylate polymer latices having glass transition temperatures of less than 50° C. and 10° C., respectively, are effective to reduce pressure desensitization of tabular grain emulsions.

Apart from the features specifically described above, the preparation and use of the emulsions of this invention follow the teachings of the art. Teachings of R-1 to R-13 inclusive are here incorporated by reference to complete disclosure of these conventional features. *Research Disclosure*, Vol. 176, December 1978, Item 17643, and Vol. 225, January 1983, Item 22534, are specifically incorporated by reference to disclose conventional photographic features compatible with the practice of this invention.

The emulsions of this invention are highly suitable for camera speed photographic applications, such as conventional black and-white and color photography and radiography.

EXAMPLES

The surface speed of the emulsions described below were evaluated in each instance as an emulsion layer on a photographic film support, the emulsion layer exhibiting a coating density of 21.5 mg/dm$^2$ silver. The emulsion layer was exposed through a graduated density step tablet for 0.1 second by a 365 nm line radiation source and then processed for 10 minutes in the following developer:

| Developer | |
|---|---|
| Elon TM (p-N-methylaminophenol hemisulfate) | 4.0 gms |
| Ascorbic acid | 5.0 gm |
| KCl | 0.4 gm |
| Dibasic sodium phosphate | 12.8 gm |
| NaOH (50% by wt.) | 1.6 cc |
| Water to 1 to liter total volume | |
| pH 7.3 at 20.5° C. | |

Pressure desensitization was measured by comparing the speed difference between coatings with and without the application of 25 psi roller pressure before exposure. To avoid any possibility of attributing differences in response to pressure to differences in sensitization, the emulsions were coated and compared without under undertaking chemical or spectral sensitization.

EXAMPLE 1

Control Emulsion

This comparative example illustrates the properties of a recent tabular grain silver bromoiodide emulsion containing non-uniform iodide prepared according to the teachings of R-12 (Solberg Piggin et al).

To 1.5 liters of a 0.2 percent by weight gelatin aqueous solution containing 0.087M sodium bromide at 35° C., pH 5.7, was added with vigorous stirring 0.3M silver nitrate solution over 30 second period (containing 0.025 percent of the total silver used). The temperature was then raised to 75° C. over five minutes and was kept constant throughout the rest of the make by adding 1.88 liters of 0.92 percent by weight gelatin aqueous solution which had been kept at 85° C. A 2.1M sodium bromide aqueous solution and a 1.88M silver nitrate aqueous solution were added by double jet addition utilizing accelerated flow (97× increase in flow rate from start to finish) for 55 minutes at pAg 8.80 at 75° C., consuming 65.7% of the total silver used. The pAg was then adjusted to 9.52 with sodium bromide solution. The emulsion was held for five minutes after 0.088 mole of silver iodide Lippmann emulsion was added. A 1.88M silver nitrate solution was added to the element until the pAg reached 8.03 at 75° C., consuming 31.6% of the total silver used. Approximately 3.23 moles of silver were used to prepare this emulsion.

The resultant high aspect ratio tabular grain silver bromoiodide emulsion had an average grain diameter of 4.0μm and a mean tabular grain thickness of 0.14 μm—thus D/$^2$ was 200. Tabular grains accounted for about 90 percent of total grain projected area. The average tabular grain aspect ratio was 28.

This emulsion exhibited a fully acceptable imaging speed when no pressure was applied, but demonstrated no measureable photographic speed in areas to which pressure was applied. This indicated a high level of pressure sensitivity. To permit comparison with subsequent emulsions this emulsion was assigned a relative log speed of 100 when no pressure was applied. Since only the difference is speeds is important in comparing emulsions, the relative log speed of 100 is an arbitrarily assigned number. The units of relative log speed are such that 100 relative log speed units difference in speed amount to a speed difference of 1.00 log E, where E is exposure in meter-candle-seconds.

EXAMPLE 2

Control Emulsion, pAg 8.80

This example demonstrates an improvement in speed, but no reduction in pressure sensitivity when silver bromoiodide laminae are formed on the major faces of the host tabular grains at a higher pAg than required by the invention.

The preparation procedure of Emulsion 1 was repeated through the five minute hold following addition of the silver iodide Lippmann emulsion. A 0.5M silver nitrate aqueous solution and a 0.6M sodium bromide aqueous solution were added by double jet addition at a constant flow rate for 24 minutes at a pAg of 8.80 at 75° C. (note point C-2 in FIG. 1), consuming 31.6% of the total silver used. Approximately 3.23 moles of silver were used to prepare this emulsion.

The resultant high aspect ratio tabular grain silver bromoiodide emulsion had an average grain diameter of 3.9 μm and a mean tabular grain thickness of 0.12 μm—thus $D/t^2$ was 271. Tabular grains accounted for about 90 percent of total grain projected area. The average tabular grain aspect ratio was 33.

This emulsion exhibited a relative log speed of 12 when no pressure was applied, but demonstrated no measureable photographic speed in areas to which pressure was applied. This indicated a high level of pressure sensitivity.

EXAMPLE 3

Control Emulsion, pAg 7.68

This example demonstrates a high level of pressure desensitization when silver bromoiodide laminae are formed on the major faces of the host tabular grains at a higher pAg than required by the invention.

The preparation procedure of Emulsion 1 was repeated through the five minute hold following addition of the silver iodide Lippmann emulsion. A 0.5M silver nitrate aqueous solution and a 0.6M sodium bromide aqueous solution were added by double jet addition at a constant flow rate for 39 minutes at a pAg of 7.68 at 75° C. (note point C-3 in FIG. 1), consuming 31.6% of the total silver used. Approximately 3.23 moles of silver were used to prepare this emulsion.

The resultant high aspect ratio tabular grain silver bromoiodide emulsion had an average grain diameter of 3.9 μm and a mean tabular grain thickness of 0.12 μm—thus $D/t^2$ was 271. Tabular grains accounted for about 90 percent of total grain projected area. The average tabular grain aspect ratio was 33.

This emulsion exhibited a relative log speed of 187 and a speed loss of 110 relative log speed units in areas subjected to the pressure.

EXAMPLE 4

Example Emulsion, pAg 6.88

This example demonstrates an improvement in speed and negligible pressure desensitization when silver bromoiodide laminae are formed on the major faces of the host tabular grains within the pAg range required by the invention.

The preparation procedure of Emulsion 1 was repeated through the five minute hold following addition of the silver iodide Lippmann emulsion. A 0.5M silver nitrate aqueous solution and a 0.5M sodium bromide aqueous solution were added by double jet addition at a constant flow rate for 52 minutes at a pAg of 6.88 at 75° C. (note point E-4 in FIG. 1), consuming 31.6% of the total silver used. Approximately 3.23 moles of silver were used to prepare this emulsion.

The resultant high aspect ratio tabular grain silver bromoiodide emulsion had an average grain diameter of 3.8 μm and a mean tabular grain thickness of 0.14 μm—thus $D/t^2$ was 195. Tabular grains accounted for about 90 percent of total grain projected area. The average tabular grain aspect ratio was 27.

This emulsion exhibited a relative log speed of 218 and a speed loss of only 4 relative log speed units in areas subjected to the pressure. This speed difference between areas free of and subjected to pressure was so small as to be negligible.

EXAMPLE 5

Example Emulsion, pAg 6.48

This example demonstrates an improvement in speed and negligible pressure desensitization when silver bromoiodide laminae are formed on the major faces of the host tabular grains within the pAg range required by the invention.

The preparation procedure of Emulsion 1 was repeated through the five minute hold following addition of the silver iodide Lippmann emulsion. A 0.5M silver nitrate aqueous solution and a 0.5M sodium bromide aqueous solution were added by double jet addition at a constant flow rate for 52 minutes at a pAg of 6.48 at 75° C. (note point E-5 in FIG. 1), consuming 31.6% of the total silver used. Approximately 3.23 moles of silver were used to prepare this emulsion.

The resultant high aspect ratio tabular grain silver bromoiodide emulsion had an average grain diameter of 3.9 μm and a mean tabular grain thickness of 0.13 μm—thus $D/t^2$ was 236. Tabular grains accounted for about 90 percent of total grain projected area. The average tabular grain aspect ratio was 30.

This emulsion exhibited a relative log speed of 221 and a speed loss of only 3 relative log speed units in areas subjected to the pressure. This speed difference between areas free of and subjected to pressure was so small as to be negligible.

EXAMPLE 6

Example Emulsion, pAg 6.09

This example demonstrates significant pressure desensitization when silver bromoiodide laminae are formed on the major faces of the host tabular grains at a lower pAg than required by the invention.

The preparation procedure of Emulsion 1 was repeated through the five minute hold following addition of the silver iodide Lippmann emulsion. A 0.5M silver nitrate aqueous solution and a 0.5M sodium bromide aqueous solution were added by double jet addition at a constant flow rate for 26 minutes at a pAg of 6.09 at 75° C., consuming 31.6% of the total silver used. Approximately 3.23 moles of silver were used to prepare this emulsion.

The resultant high aspect ratio tabular grain silver bromoiodide emulsion had an average grain diameter of 4.1 μm and a mean tabular grain thickness of 0.13 μm—thus $D/t^2$ was 248. Tabular grains accounted for about 90 percent of total grain projected area. The average tabular grain aspect ratio was 32.

This emulsion exhibited a relative log speed of 78 and speed loss of 24 relative log speed units in areas subjected to the pressure. The pressure desensitization of this control emulsion was significant, but lower than any of the control emulsions, viewing speed after pressure application as a percentage of initial speed. Unlike Examples 2 and 3, Example 6 is a novel emulsion further removed from the prior art than the remaining emulsions of this invention—e.g., Examples 4 and 5.

EXAMPLE 7

The Example 1 control emulsion (hereinafter referred to as C-1) and the Example 4 emulsion of this invention (hereinafter referred to as E-4) were each optimally sulfur and gold chemically sensitized and then each optimally spectrally sensitized with the same combination of the following spectral sensitizing dyes:

Dye 1 Anhydro-11-ethyl-1,1'-bis(3-sulfopropyl)-naphth[1,2-d]oxazolocarbocyanine hydroxide, sodium salt and Dye 2 Anydro-5-chloro-9-ethyl-5'-phenyl-3'-(3-sulfobutyl)-3-(3-sulfopropyl)oxacarbocyanine hydroxide, sodium salt.

C-1 and E-4, optimally chemically and spectrally sensitized, were each blended with a magenta dye-forming coupler and coated on a photographic film support at a silver coverage of 10.76 mg/dm$^2$. The coatings were exposed to daylight at a color temperature of 5500° K. for 0.01 second, followed by development for 2 minutes 30 seconds using the Kodak Flexicolor C-41# process (described in *British Journal of Photography Annual*, 1977, pp. 201-206).

C-1 exhibited a relative log speed of 231 without pressure application and 224 after pressure application, showing a speed loss of 7 relative log speed units.

E-4 exhibited a relative speed of 225 without pressure application and a granularity 4 rms grain units less than C-1, indicating a superior speed-granularity position for E-4 as compared to C-1.

After pressure application E-4 still demonstrated a speed of 225, indicating that no pressure desensitization had taken place. Thus emulsion E-4 showed a superior speed-granularity relationship and a superior insensitivity to pressure as compared to C-1.

When C-1 and E-4 were coated in their primitive states (i.e., without chemical or spectral sensitization) and compared similarly as Examples 1 to 6 above, C-1 showed a total loss of sensitivity following pressure application whereas E-4 demonstrated a speed reduction of 3 relative log speed units attributable to pressure application.

The invention has been described in detail with particular reference to preferred embodiments thereof, but it will be understood that variations and modifications can be effected within the spirit and scope of the invention.

What is claimed is:

1. A process for the preparation of a silver bromoiodide emulsion comprising modifying a host emulsion comprised of a dispersing medium and silver bromide or bromoiodide grains in which greater than 50 percent of the total grain projected area is accounted for by tabular grains satisfying the relationship $$ECD/t^2 > 25$$

where

ECD is the mean effective circular diameter in μm of the tabular grains and t is the mean thickness in μm of the tabular grains by forming silver bromoiodide laminae on the major faces of the tabular grains so that sensitivity as a function of pressure applied to the silver bromoiodide emulsion is rendered more nearly constant by the steps of (a) adjusting the pAg and temperature of the host emulsion to lie within the boundaries defined by Curve A in FIG. 1, (b) depositing iodide as a silver salt at peripheral sites on the host tabular grains in less than 10 minutes, and (c) within the pAg and temperature boundaries defined by Curve A in FIG. 1, precipitating silver bromoiodide onto the major faces of the host tabular grains with the primary source of iodide being the iodide deposited in step (b).

2. A process according to claim 1 further characterized in that the silver bromoiodide laminae on the major faces of the tabular grains are formed within the pAg and temperature boundaries defined by Curve B in FIG. 1.

3. A process according to claim 1 further characterized in that iodide is introduced in step (b) as an alkali metal iodide.

4. A process according to claim 3 further characterized in that iodide is introduced in step (b) as potassium iodide.

5. A process according to claim 1 further characterized in that iodide is introduced in step (b) as a silver iodide Lippmann emulsion.

6. A process according to claim 1 further characterized in that the iodide introduced during step (b) constitutes from 0.1 to 40 mole percent, based on silver, of the total halide forming the silver bromoiodide emulsion.

7. A process according to claim 6 further characterized in that the iodide introduced during step (b) constitutes from 0.5 to 4 mole percent, based on silver, of the total halide forming the silver bromoiodide emulsion.

8. A process according to claim 1 further characterized in that step (b) is completed in less than 1 minute.

9. A process according to claim 8 further characterized in that step (b) is completed in less than 10 seconds.

10. A process according to claim 1 further characterized in that iodide constitutes less than 5 mole percent of total halide introduced during step (c).

11. A process according to claim 10 further characterized in that iodide constitutes less than 1 mole percent of total halide introduced during step (c).

12. A process according to claim 11 further characterized in that bromide is the sole halide introduced during step (c).

13. A process according to claim 1 further characterized in that step (c) is continued until the iodide introduced during step (b) is redistributed over the major faces of the tabular grains.

14. A process according to claim 13 further characterized in that at least 5 percent of the total silver forming the silver bromoiodide emulsion is introduced during step (c).

15. A process according to claim 14 further characterized in that at least 10 percent of the total silver forming the silver bromoiodide emulsion is introduced during step (c).

16. A process according to claim 1 further characterized in that the host emulsion is a silver bromide emulsion.

17. A process according to claim 1 further characterized in that the pAg of the host emulsion is adjusted to within the range defined by Curve B in FIG. 1 prior to performing step (b).

18. A process for the preparation of a silver bromoiodide emulsion comprising modifying a silver bromide host emulsion in which greater than 50 percent of the total grain projected area is accounted for by tabular grains satisfying the relationship $$ECD/t^2 > 25$$

where

ECD is the mean effective circular diameter in μm of the tabular grains and t is the mean thickness in μm of the tabular grains, by forming silver bromoiodide laminae on the major faces of the tabular grains so that sensitivity as a function of pressure applied to the silver bromoiodide emulsion is rendered more nearly constant by the steps of (a) adjusting the pAg and temperature of the host emulsion to lie within the boundaries defined by Curve B in FIG. 1, (b) depositing iodide as a silver salt at peripheral sites on the host tabular grains, this step including introducing iodide into the host emulsion in less than 10 seconds, silver deposited in this step accounting for from 0.5 to 4 mole percent of the total silver forming the silver bromoiodide emulsion, and (c) within the pAg and temperature boundaries defined by Curve B in FIG. 1, introducing additional silver and bromide to precipitate onto the major faces of the host tabular grains silver bromoiodide, the iodide content of which is that supplied by step (b), silver precipitated in step (c) accounting for at least 10 mole percent of the total silver forming the silver bromoiodide emulsion.

* * * * *